US010570641B2

(12) United States Patent
Pavey

(10) Patent No.: US 10,570,641 B2
(45) Date of Patent: Feb. 25, 2020

(54) PARKING BARRIER SYSTEM AND POST

(71) Applicant: Industrial Glavanizers Corporation Pty Ltd., Minto, New South Wales (AU)

(72) Inventor: Peter Pavey, Victoria (AU)

(73) Assignee: Industrial Galvanizers Corporation Pty Ltd, Minto NSW (AU)

( * ) Notice: Subject to any disclaimer, the term of this patent is extended or adjusted under 35 U.S.C. 154(b) by 761 days.

(21) Appl. No.: 15/092,770

(22) Filed: Apr. 7, 2016

(65) Prior Publication Data

US 2017/0152675 A1 Jun. 1, 2017

(30) Foreign Application Priority Data

Nov. 27, 2015 (AU) ..... 2015261682

(51) Int. Cl.

| | |
|---|---|
| ***E04F 15/00*** | (2006.01) |
| ***E04H 17/20*** | (2006.01) |
| ***E01F 15/00*** | (2006.01) |
| ***E04H 17/14*** | (2006.01) |
| ***E04H 17/22*** | (2006.01) |

(52) U.S. Cl.

CPC ..... *E04H 17/20* (2013.01); *E01F 15/00* (2013.01); *E04H 17/1413* (2013.01); *E04H 17/22* (2013.01); *E04H 2017/1447* (2013.01)

(58) Field of Classification Search

CPC ..... E04H 17/14; E04H 17/20; E04H 17/22; E04H 17/413; E04H 2017/1447; E01F 15/02; E01F 15/04; E01F 15/0415; E01F 15/0438; E01F 15/0461; E01F 15/0476; E01F 15/145; E01F 15/146; E01F 15/01; E01F 9/623; E01F 9/627; E01F 9/629

USPC ..... 256/13.159, 64, 65.01, 65.02, 65.14, 256/DIG. 5; 404/6, 9; 52/846

See application file for complete search history.

(56) References Cited

U.S. PATENT DOCUMENTS

| | | | |
|---|---|---|---|
| 2,025,014 | A | 12/1935 | Brickman et al. |
| 2,520,313 | A | 8/1950 | Harris |
| 3,214,142 | A | 10/1965 | Brown et al. |
| 2,317,249 | A | 6/1968 | Brickman |

(Continued)

FOREIGN PATENT DOCUMENTS

| | | | |
|---|---|---|---|
| AU | 2013234430 | B1 | 4/2014 |
| AU | 2014200471 | A1 | 5/2015 |

(Continued)

OTHER PUBLICATIONS

Ingal Civil Products, "Car Park & Industrial Barriers Product Manual: Off Highway Vehicle Safety Barriers," Release 004, Jan. 2013.

(Continued)

*Primary Examiner* — Daniel J Wiley
(74) *Attorney, Agent, or Firm* — Cahn & Samuels, LLP

(57) ABSTRACT

A post assembly (10,10.0, 10.00, 10.000, 10.0000, 110, 210, 310) for a parking lot barrier system (11), the post (12) of the post assembly (10,10.0, 10.00, 10.000, 10.0000, 110, 210, 310) being of any appropriate section and having at least one aperture (30, 32) at or near to the base (12.1) of the post (12). The at least one aperture (30, 32) is sized and shaped so as to allow the post (12) to deform elastically under collision loads at low speeds sign posted in parking lots.

21 Claims, 11 Drawing Sheets

(56) References Cited

U.S. PATENT DOCUMENTS

| | | | | |
|---|---|---|---|---|
| 3,388,892 | A * | 6/1968 | Case | E01D 19/103 256/13.1 |
| 3,468,574 | A * | 9/1969 | Schell, Jr. | E04G 7/26 403/230 |
| 3,493,213 | A | 2/1970 | Ackerman | |
| 3,617,076 | A | 11/1971 | Attwood et al. | |
| 3,982,735 | A | 9/1976 | Fornells | |
| 4,158,998 | A * | 6/1979 | Clement | A47B 57/16 108/147.15 |
| 4,759,161 | A * | 7/1988 | Kucyk, Jr. | E01F 9/635 404/10 |
| 5,125,194 | A * | 6/1992 | Granger | E01F 9/685 403/2 |
| 5,152,507 | A | 10/1992 | Lee | |
| 5,172,891 | A | 12/1992 | Chen | |
| 5,188,342 | A | 2/1993 | Ouellette et al. | |
| 5,219,241 | A | 6/1993 | Picton | |
| 5,297,890 | A | 3/1994 | Commins | |
| 5,429,449 | A | 7/1995 | Baatz | |
| 5,657,966 | A * | 8/1997 | Cicinnati | E01F 15/0438 256/13.1 |
| 5,660,375 | A | 8/1997 | Freeman | |
| 6,007,269 | A | 12/1999 | Marinelli | |
| 6,036,399 | A | 3/2000 | Schalk | |
| 6,168,346 | B1 | 1/2001 | Ernsberger | |
| 6,220,576 | B1 | 4/2001 | Chan | |
| 6,301,846 | B1 * | 10/2001 | Waalkes | A47B 21/06 52/220.7 |
| 6,516,573 | B1 * | 2/2003 | Farrell | E01F 9/635 116/63 R |
| 6,575,656 | B2 | 6/2003 | Suh | |
| 6,644,888 | B2 * | 11/2003 | Ochoa | E01F 15/0438 404/6 |
| 6,962,328 | B2 * | 11/2005 | Bergendahl | E01F 15/06 256/1 |
| 7,229,050 | B2 * | 6/2007 | Schloss | H05K 7/1491 211/26 |
| 7,445,402 | B1 | 11/2008 | Chen | |
| 7,478,796 | B2 | 1/2009 | Burkett | |
| 7,530,548 | B2 * | 5/2009 | Ochoa | E01F 15/0423 256/13.1 |
| 7,731,159 | B2 * | 6/2010 | Amengual Pericas | E01F 15/0438 256/13.1 |
| 7,832,713 | B2 | 11/2010 | King | |
| 7,980,519 | B2 | 7/2011 | Chen | |
| 7,997,824 | B2 | 8/2011 | Amengual Pericas | |
| 8,353,499 | B2 * | 1/2013 | Conway | E01F 15/0423 256/13.1 |
| 8,382,070 | B1 * | 2/2013 | Gibbs | E04H 17/1434 256/65.02 |
| 8,858,112 | B2 * | 10/2014 | Wallace | E01F 15/0423 256/13.1 |
| 9,051,699 | B2 * | 6/2015 | Rowland | E01F 15/043 |
| 9,163,418 | B2 * | 10/2015 | Ditta | E04G 21/3204 |
| 9,200,417 | B2 * | 12/2015 | Leonhardt | E01F 15/0461 |
| 9,758,936 | B2 * | 9/2017 | Wallace | E01F 15/0461 |
| 2001/0048846 | A1 * | 12/2001 | Ochoa | E01F 15/0423 404/6 |
| 2002/0053664 | A1 | 5/2002 | Moore | |
| 2005/0269558 | A1 | 12/2005 | Keefe | |
| 2007/0003361 | A1 | 1/2007 | Wang | |
| 2007/0245681 | A1 * | 10/2007 | Patton | E04F 21/1855 52/846 |
| 2008/0224114 | A1 | 9/2008 | Cheng | |
| 2009/0050863 | A1 | 2/2009 | Conway et al. | |
| 2009/0050864 | A1 | 2/2009 | Conway | |
| 2009/0206308 | A1 * | 8/2009 | Amengual Pericas | E01F 15/043 256/13.1 |
| 2010/0126106 | A1 * | 5/2010 | Ivarsson | E04B 2/767 52/696 |
| 2011/0095250 | A1 | 4/2011 | Dyke et al. | |
| 2014/0110652 | A1 * | 4/2014 | Leonhardt | E01F 15/0461 256/13.1 |
| 2016/0237633 | A1 * | 8/2016 | Wallace | E01F 15/0461 |

FOREIGN PATENT DOCUMENTS

| | | | |
|---|---|---|---|
| AU | 2012262645 | B2 | 9/2015 |
| DE | 3640821 | C1 | 3/1988 |
| EP | 0307796 | A1 | 3/1989 |
| EP | 0554864 | A1 | 8/1993 |
| EP | 0708206 | A1 | 4/1996 |
| EP | 1650351 | B1 | 10/2005 |
| EP | 1813725 | A1 | 8/2006 |
| EP | 1857594 | B1 | 6/2010 |
| FR | 1570598 | B1 | 6/1969 |
| GB | 2397604 | A | 7/2004 |
| GB | 1319173.9 | | 5/2015 |
| JP | 2791288 | B2 | 8/1998 |
| JP | 2008128487 | A | 6/2008 |
| KR | 200300015 | Y1 | 1/2003 |
| KR | 200316380 | Y1 | 6/2003 |
| KR | 200341426 | Y1 | 2/2004 |
| KR | 20060073218 | A | 6/2006 |
| KR | 10-2008-0109207 | A | 12/2008 |
| WO | 2007079520 | A1 | 7/2007 |
| WO | 2009025997 | A2 | 2/2009 |

OTHER PUBLICATIONS

Espacenet, English abstract of EP1857594 (A1), printed on Sep. 7, 2016.

Espacenet, English abstract of EP1650351(A2), printed on Sep. 7, 2016.

Espacenet, English abstract for EP0307796A1, Mar. 22, 1989.

Espacenet, English abstract for DE3640821C1, Mar. 24, 1988.

Roads and Traffic Authority (RTA), NSW, Drawing No. MD.R201. CO5.A.1 "Pedestrian Fence Intermediate Post with Base Plate," drawing dated Nov. 5, 2009, pp. 1-2.

Ingal Civil Products, "Pedestrian Fencing Roadside Safety Fence Product Manual," Release Jan. 2011, Jan. 2011, pp. 1-8.

Safe Direction Pty Ltd, "Rhino-Stop Modular Vehicle Impact Barriers Product Manual," attached to an e-mail dated Jul. 16, 2015, pp. 1-26.

Wallace, Hayden, Statutory Declaration (includes attachment Annexure "D"), Aug. 20, 2019, pp. 1-4.

* cited by examiner

FIGURE 9
FIGURE 10
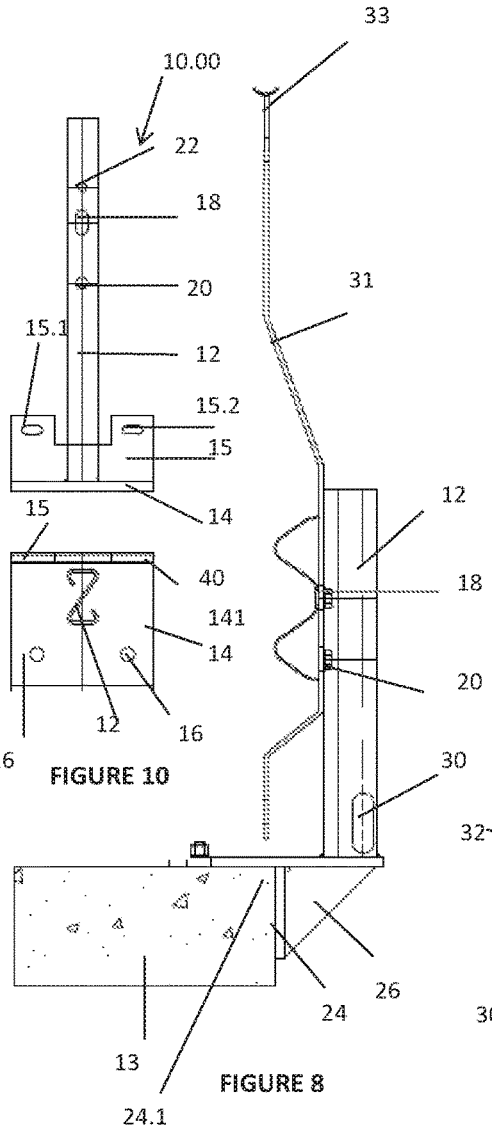
FIGURE 8
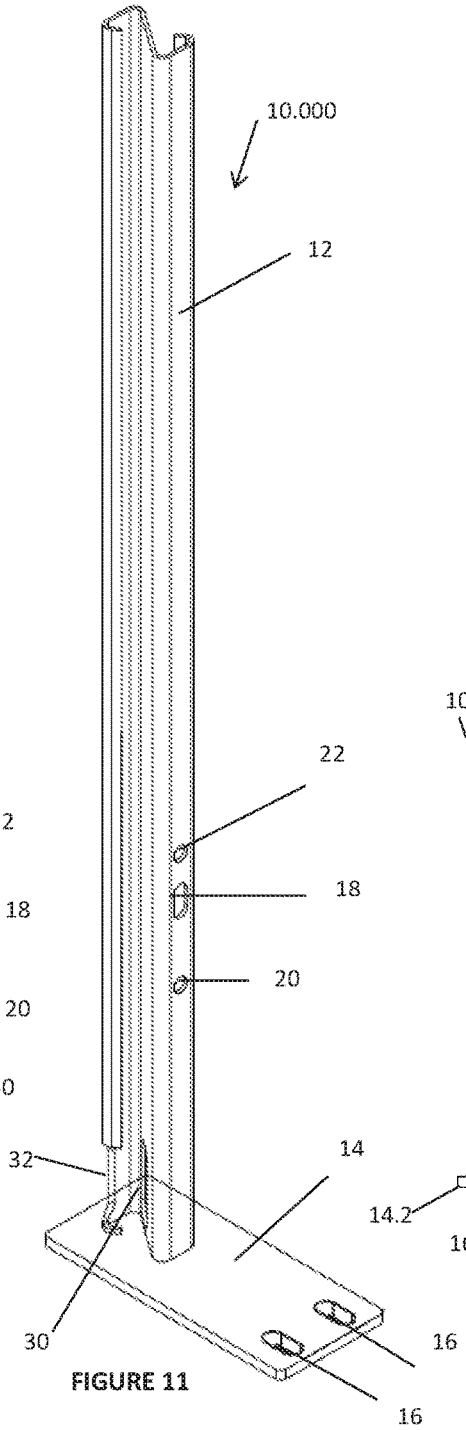
FIGURE 11
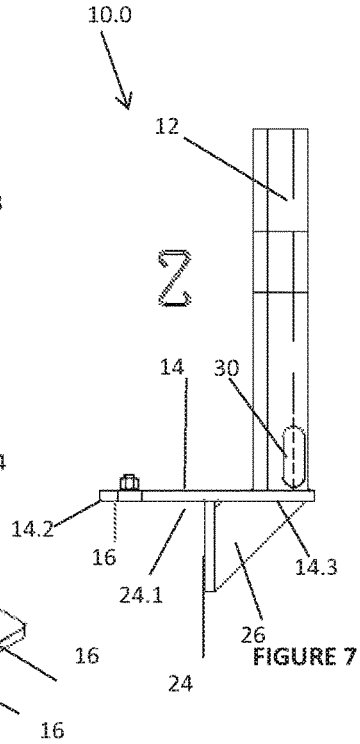
FIGURE 7

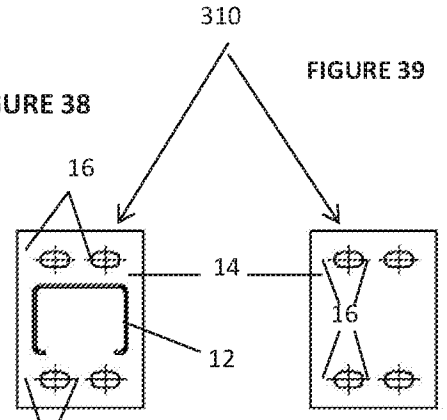
FIGURE 38
FIGURE 39
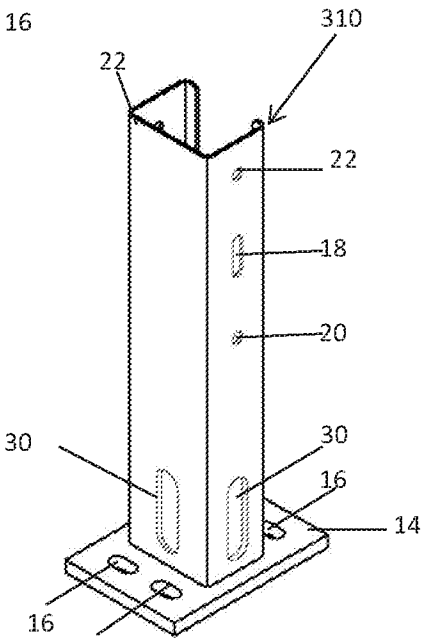
FIGURE 33
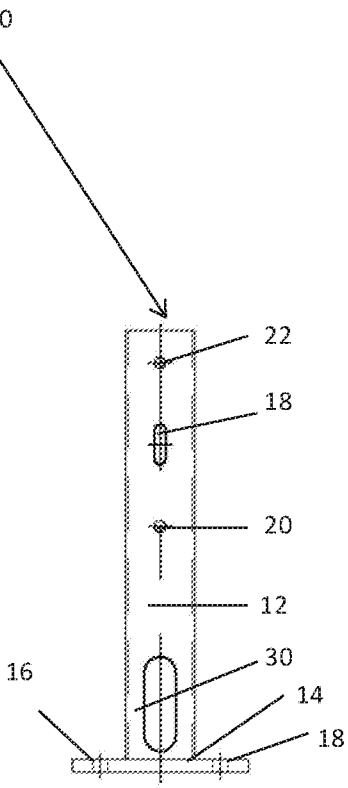
FIGURE 37
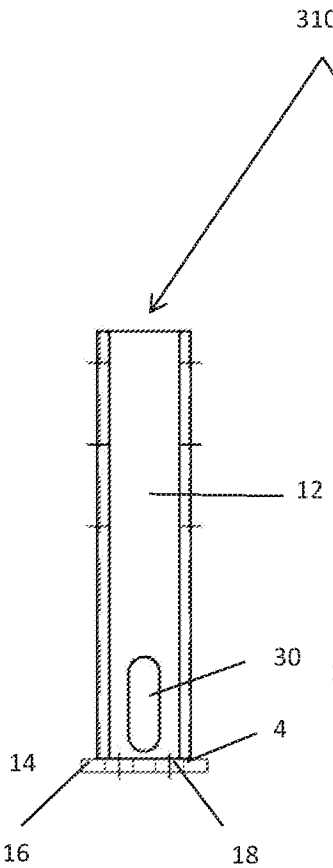
FIGURE 36
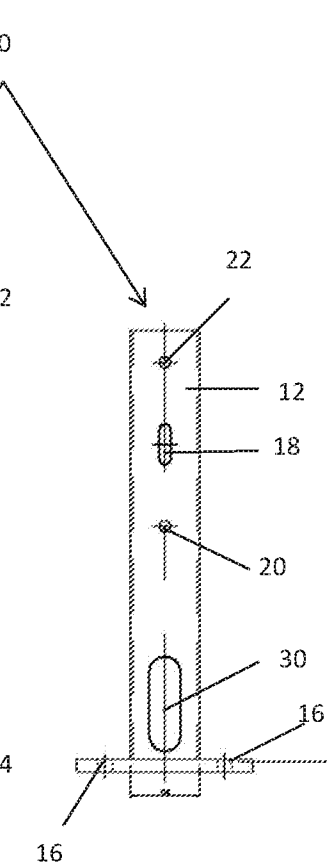
FIGURE 35
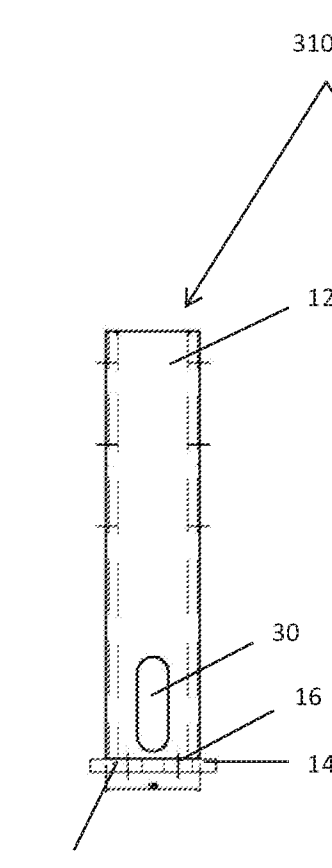
FIGURE 34

PARKING BARRIER SYSTEM AND POST

This patent application claims priority to Australian patent application number 2015261682 filed on Nov. 27, 2015, which application is hereby incorporated by reference in its entirety.

I. FIELD OF THE INVENTION

The present invention relates to improvements in posts for guard rail systems which are used in car parking environments such as car parking lots and garages, and an improved barrier utilizing such an improved post.

II. BACKGROUND OF THE INVENTION

Guard rail barriers for highway and roadway use are designed to prevent the colliding vehicles from passing through the barrier, if the collision is within in a range of designed for vehicle speeds and vehicle types.

These guard rail barriers tend to not be used in car parking areas because the posts used on roads and highways need to absorb too much energy, and thus are relatively rigid with respect to car parking use, where the speeds of vehicles tend to be much slower than on the road or in highway collisions with barrier systems.

Any reference herein to known prior art does not, unless the contrary indication appears, constitute an admission that such prior art is commonly known by those skilled in the art to which the invention relates, at the priority date of this application.

III. SUMMARY OF THE INVENTION

The present invention provides a post assembly for a parking lot barrier system, the post of the post assembly being of any appropriate section and being characterized in that at or near to the base of the post there is located at least one aperture which is sized and shaped so as to allow the post to deform elastically under collision loads at low speeds.

The at least one aperture is elongated whereby the longitudinal axis is located generally in a vertical direction.

The post in cross-section includes two flanges connected together by a connecting web.

The least one aperture can be located in a rear flange when in use.

The at least one aperture can be located in the web linking front and rear flanges.

The at least one aperture can be located in the web at location which is closer to a rear flange of the post than to a front flange.

The at least one aperture can be located in the web at a central location relative to the width of the web.

There can be at least one aperture in at least a rear flange and the web.

Each flange and the web can include at least one aperture.

The post can have a flange with a free edge, and can have the at least one aperture formed therein, such that the aperture has a discontinuous periphery.

The post can have a flange with a free edge, and can have the at least one aperture formed therein, such that the aperture has a discontinuous periphery.

The post can have a flange with a free edge, and can have the at least one aperture formed therein, such that the aperture has a periphery which is closed.

The at least one aperture formed therein is such that the aperture can have a periphery which is closed.

The at least one aperture can be a multiple of apertures including at least one peripherally closed aperture and one peripherally open aperture.

The post can include at least one mounting hole to mount a two lobe beam or a three lobe beam, such as a W-beam or a THRIEBEAM branded beam, to the post.

The post can include at least one mounting hole to mount a hand rail support to the post.

The post can have a cross section which can be generally described as one of the following: C-cross section; U-cross section, I-cross section; H-cross section; Z-cross section; Ochoa or O-post cross section.

The post assembly can include a base plate attached to the post for securing the assembly to an anchor pad or foundation or concrete formation.

The base is one of the following: flat; able to be positioned on an external corner; able to be positioned on an internal corner; able to be positioned on an external corner of 90 degrees; of able to be positioned on an internal corner of 90 degrees.

The present invention also provides a guard rail assembly having a multiple number of posts or post assemblies as described above, and a two lobe beam or a three lobe beam mounted to the posts.

The guard rail assembly can also include hand rails mounted by means of offset members supporting the hand rails and the offset members being mounted to the posts or the beam extending between the posts.

IV. BRIEF DESCRIPTION OF THE DRAWINGS

A detailed description of at least one embodiment will follow, by way of example only, with reference to the accompanying figures of the drawings, in which:

FIG. 7 illustrates a left side elevation of the post of FIG. 5.

FIG. 8 illustrates a left side elevation of the post of FIG. 5, as installed on the edge of a car parking slab or deck and fitted with a crank hand rail support.

FIG. 9 illustrates a front view of a post embodying the invention mounted to a base suitable for attaching building façade panels and/or mounting systems;

FIG. 10 illustrates a plan view of a post embodying the invention mounted to a base suitable for attaching building façade panels and/or mounting systems;

FIG. 11 illustrates a perspective view of a 2 meter Z-section post and base embodying the invention;

FIGS. 33 to 39 illustrate a perspective view, front view, right side view, rear view, left side view, plan view and underneath view respectively of a C-post or Charlie post embodying the invention.

V. DETAILED DESCRIPTION OF THE INVENTION

Figure 1:
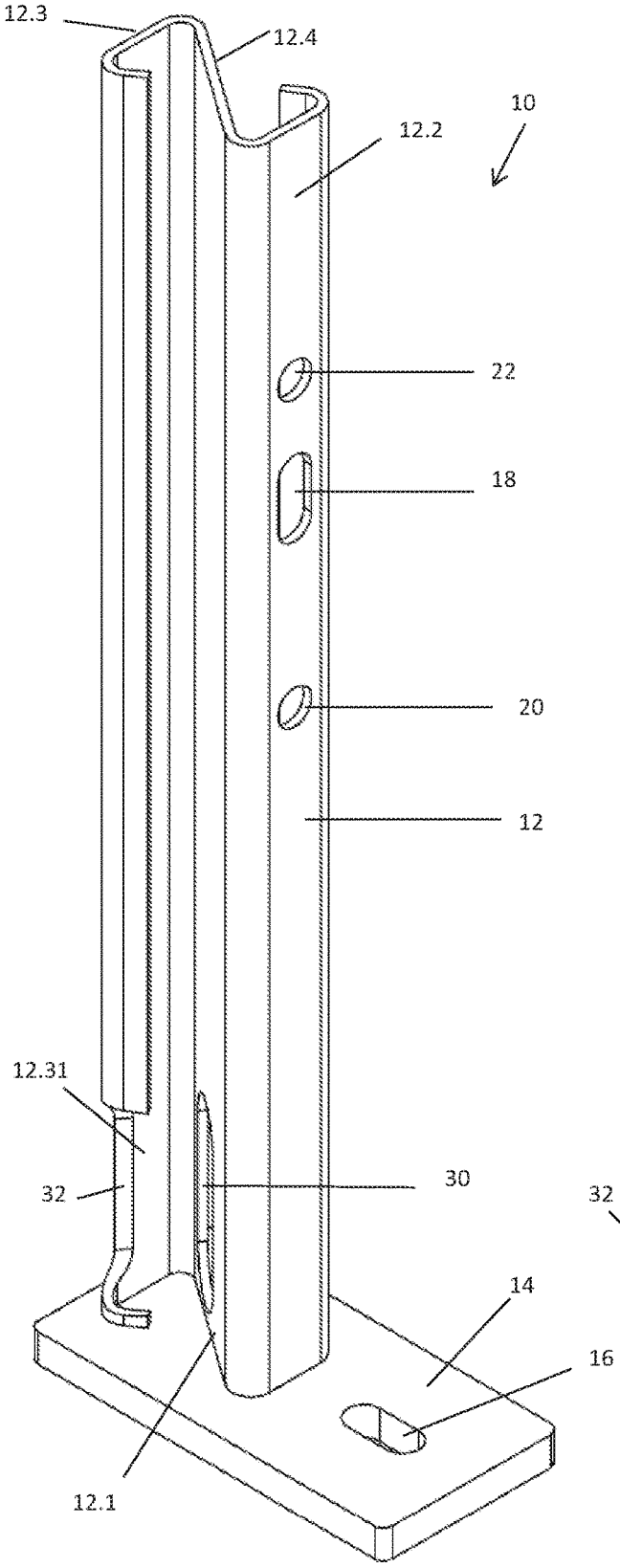
FIG. 1 illustrates a perspective view of a Z section post embodying the invention.
Figure 2:
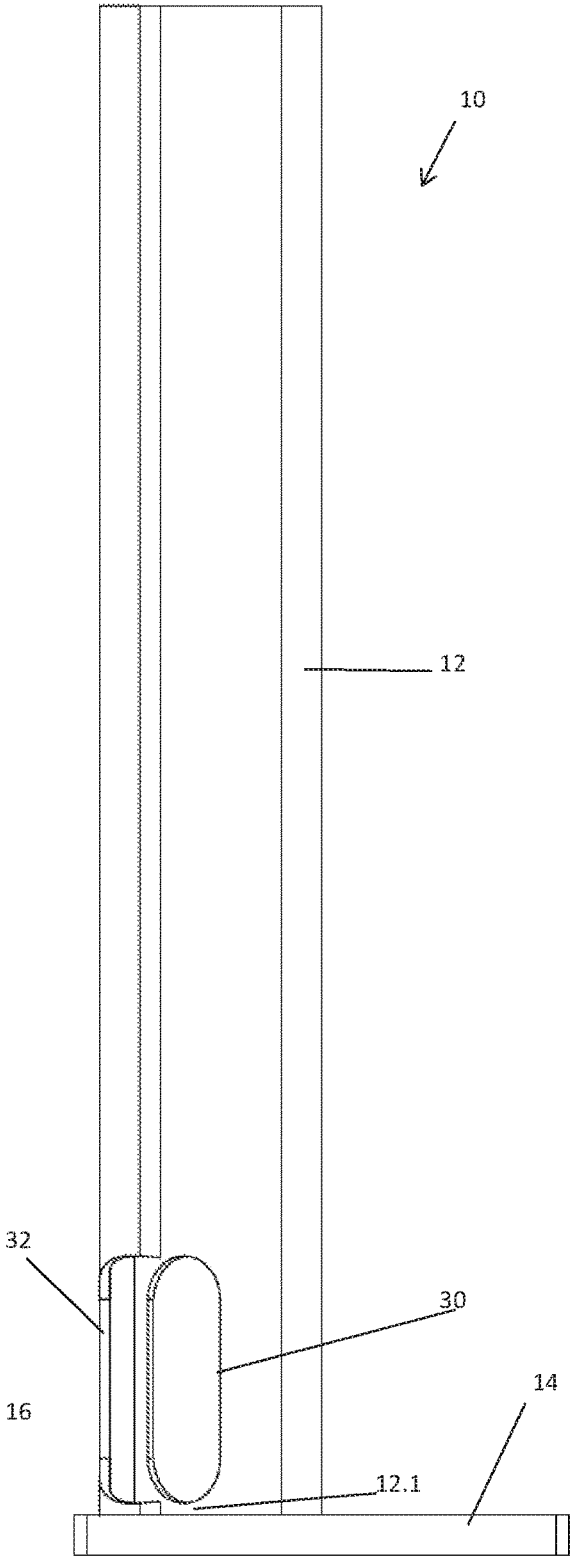
FIG. 2 illustrates a right side elevation of the post of FIG. 1.
Figure 3:
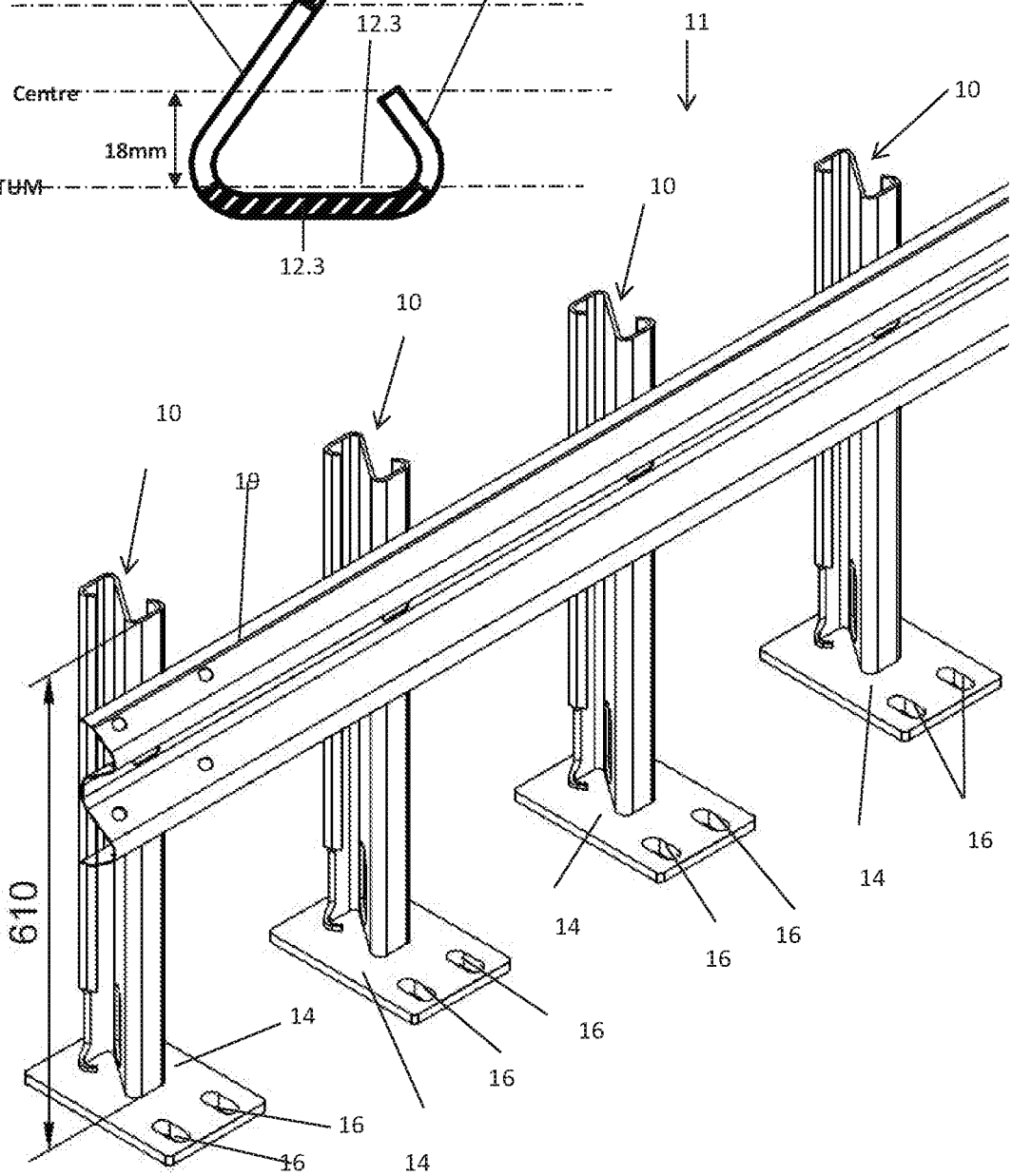
FIG. 3 illustrates a perspective view of a parking lot barrier assembly utilizing the post of FIGS. 1 and 2.
Figure 4:
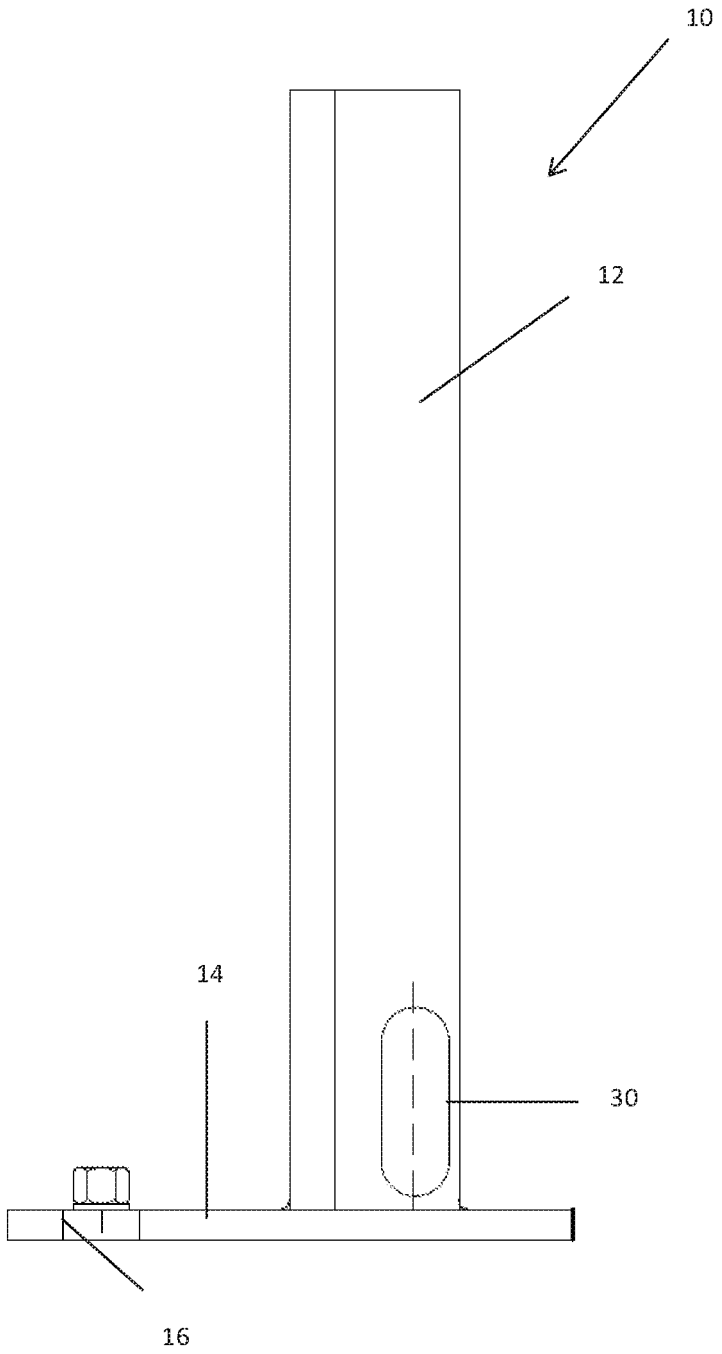
FIG. 4 illustrates a left side view of the post of FIG. 1 when mounted on base suitable for securing to a parking deck edge such as an edge of a concrete slab.
Figure 5:
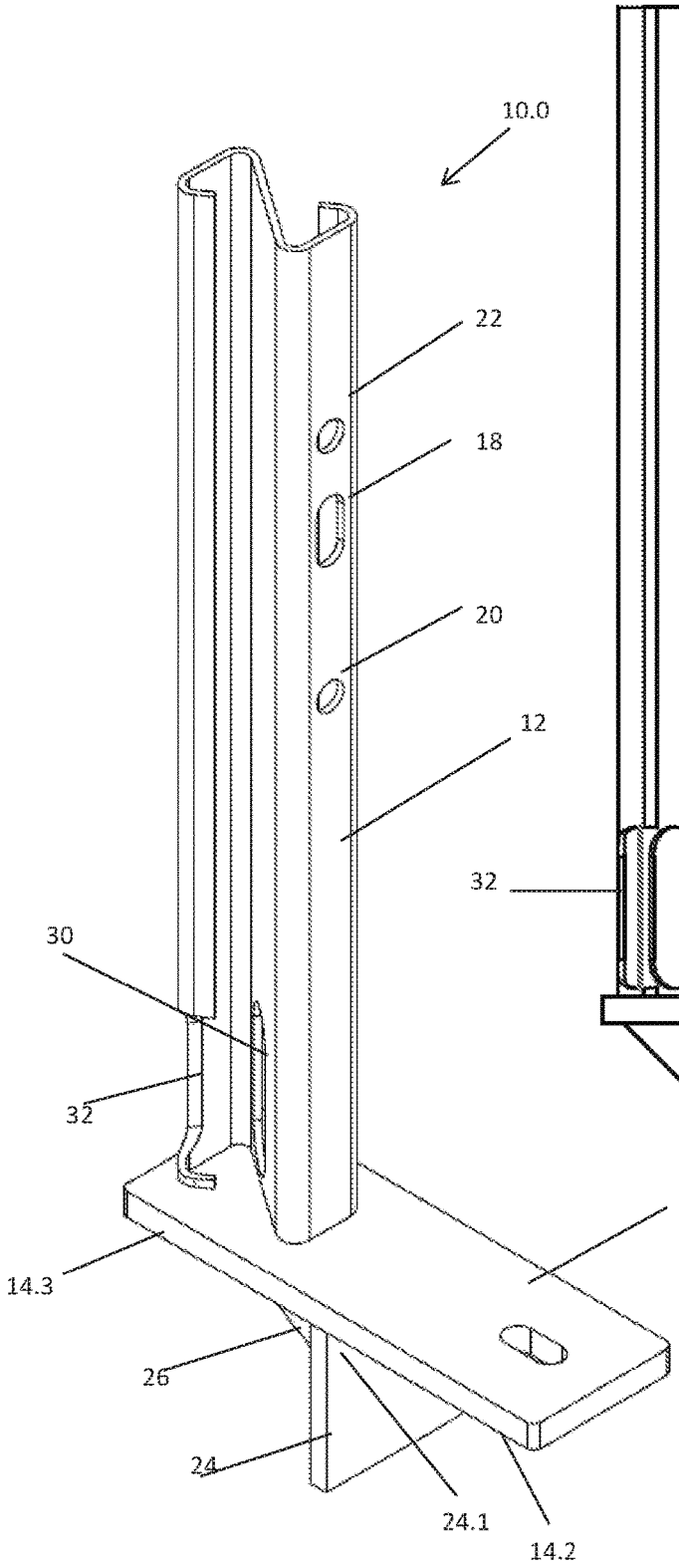
FIG. 5 illustrates a perspective view of the post of FIG. 1 when mounted on a base suitable for securing to a parking deck edge such as the edge of a concrete slab.
Figure 6:
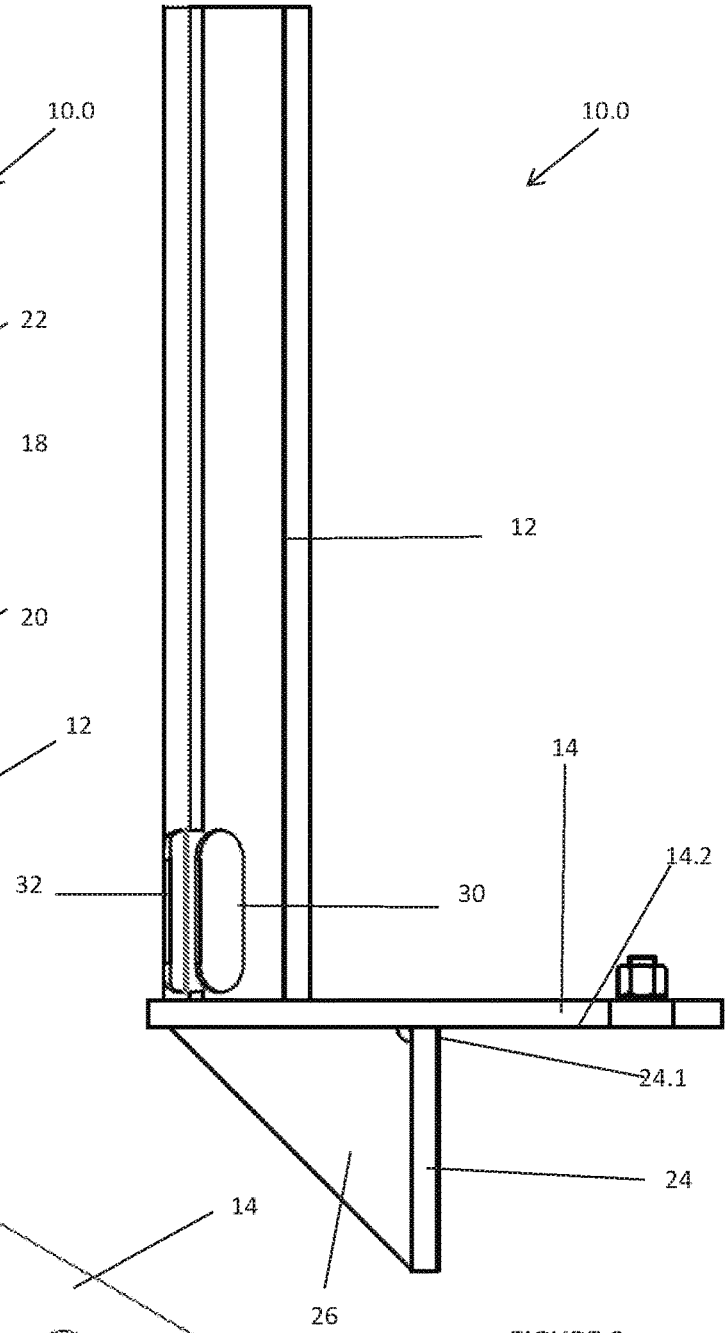
FIG. 6 illustrates a left side elevation of the post of FIG. 5.
Figure 12:
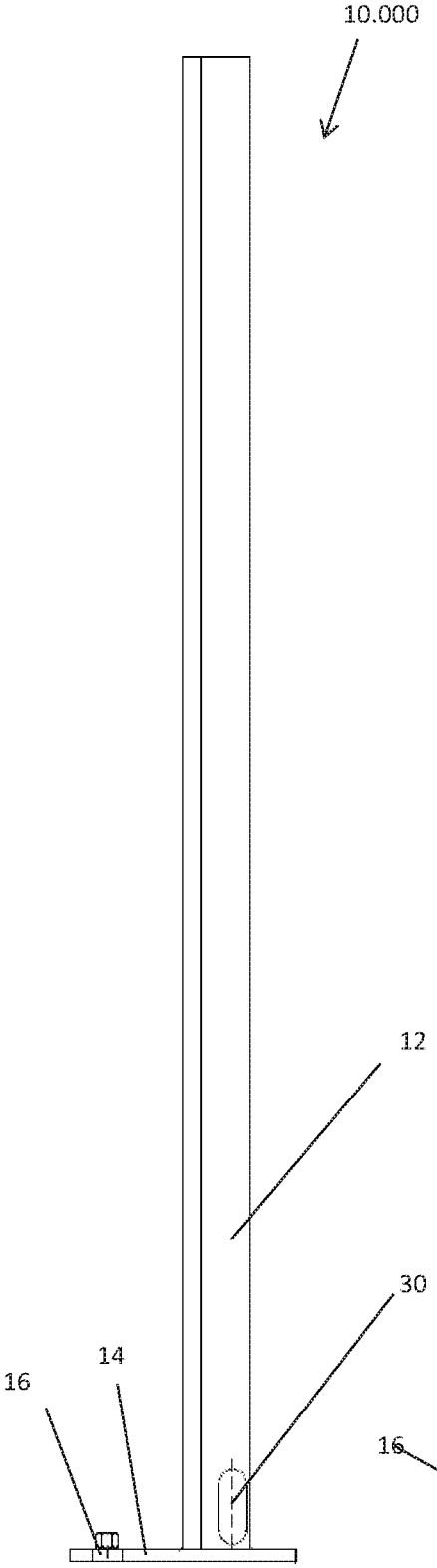
FIG. 12 illustrates a left side view of the post of FIG. 11.
Figure 13:
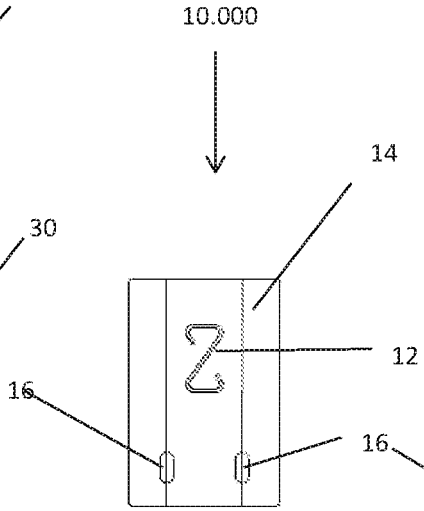
FIG. 13 illustrates a plan view of the post and base of FIG. 11
Figure 14:
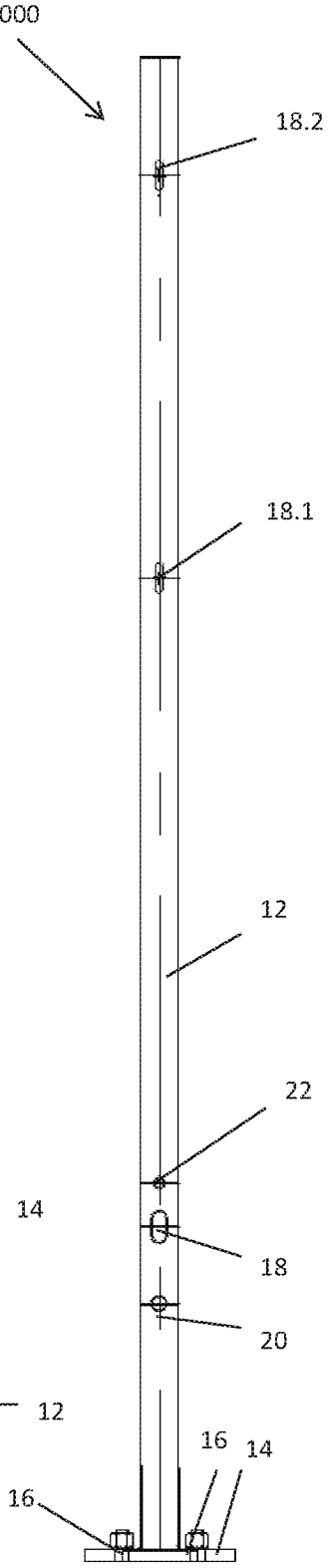
FIG. 14 illustrates a front view of the post and base of FIG. 11.

As illustrated in FIGS. 1 to 4 is a post assembly 10 for a parking lot barrier system 11 as illustrated in FIG. 3, wherein the post assembly has a post 12 of any appropriate cross section, in this case a Z-cross section. At or near to a base 12.1 of the post 12 there is located at least one aperture or slot 30 which is sized and shaped so as to allow the post 12 to deform elastically under collision loads at low speeds sign posted in parking lots. In respect of the post 12 as illustrated in FIG. 1, for an average vehicle mass of approximately 1450 Kgs the post 12 will elastically deform when collided with at speeds of up to 18 km/h, and that collision occurs at a theoretical height of 500 mm from the post base 12.1, whereas for speeds above this, plastic deformation is expected to occur.

The aperture 30 can be generally described as obround and is 36 mm in width with the major longitudinal axis being 100 mm, which is measured from the center of the upper arch to the center of the lower trough. The arch and trough have a radius of 18 mm.

The post 12 can be secured to an anchor formation such as a concrete foundation or a deck 13 (see FIG. 8), by means of a base plate 14 which has at least one mounting aperture 16 therein, so as to secure the post assembly 10 to a deck 13 or other concrete foundation.

The at least one aperture 30 is elongated whereby the longitudinal axis is located generally in a vertical direction in the post 12, as is best illustrated in FIG. 2.

The post 12 in cross section includes two flanges 12.2 and 12.3 connected together by a connecting web 12.4. The web 12.4 as described below is of a thickness of 4.3 mm.

The least one aperture 30 is preferably located in the rear flange 12.3 when in use.

Alternatively the least one aperture 30 can be located in the web 12.4 linking front and rear flanges 12.2 and 12.3 respectively.

The at least one aperture 30 can also be located in the web 12.4 at location which is closer to a rear flange 1.3 of the post than to a front flange 12.2.

The at least one aperture 30 can be located in the web at a central location relative to the width of the web.

There can be at least one aperture 30 in at least the rear flange 12.3 and the web 12.4.

Each flange 12.3 and 12.2 and the web 12.4 can include at least one aperture 30, as will be described below with respect of FIGS. 19 to 39.

The post 12 has its flange 12.2 and 12.3 providing a free edge, and the at least one aperture 30 or part aperture 32, can be formed therein. The aperture 32 has a discontinuous periphery in the case of the posts of FIGS. 1 to 18, that is, in the nature of an open periphery slot or a bight. The aperture 32 is an identical in dimension to the aperture or slot 30 described above, except that is bisected along the major axis.

The two slots 30 and 32 effectively reduce the material cross section of the post, when the post is sectioned by a horizontal plane through the center of the apertures 30 and 32, that horizontal plane being perpendicular to the major axis. Without apertures 30 and 32 the cross sectional area of the post would be some 930.95 $mm^2$, however this is reduced to 758.95 $mm^2$. This represents a reduction of 18.5%. The slots 30 and 32 allow the post material to deform into the void by the slots 30 and 32 in the event of a collision.

Figure 2A:
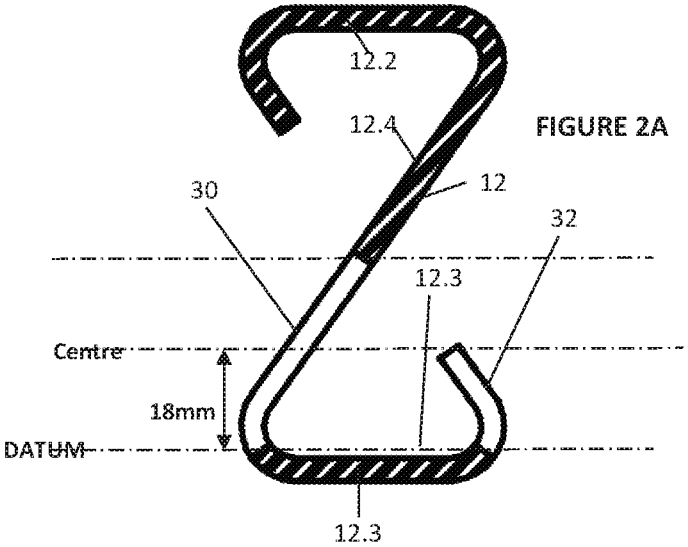
FIG. 2A is a cross section through when the post is cross sectioned by a horizontal plane through the aperture or slot at approximately 70 mm up from the base of the post.

The slot 30 is positioned so as to remove material in the vicinity of the rear section of the web 12.4. Another aperture, in this case a part aperture 32 is positioned in the rear flange 12.3. As illustrated in FIG. 2A, the datum for the location of the apertures or slots 30 and 32 is effectively from the inside or inboard face 12.31 (seen in FIGS. 1 and 2A) of the rear flange 12.3, with the center of the aperture 30 being approximately 18 mm from the inboard face 12.31, while the center of the long side of the same sized "half" slot or aperture 32 is also approximately 18 mm measured perpendicularly from the face 12.31. Alternatively the aperture 30 can have a periphery which is closed, which is in the flange 12.2 or 12.3 as in the example of the posts of FIGS. 19 to 39.

In the example of the post of FIGS. 1 to 18, the post 12 has one peripherally closed aperture being aperture 30 in the web 12.4 and one peripherally open aperture being aperture 32 in the rear flange 12.3.

The post 12 includes a mounting hole 18 to mount a beam 19 such as two lobe or three lobe beam 19, as illustrated in FIG. 3, to the post 12, which is indicated as having a height of approximately 610 mm above the base plate 14. This produces a guard rail system 11 suitable for a car parking environment, where speeds of collision, in the main, tend to be much lower than can occur on roads and highways, as car parking areas tend to have speed sign postings which are generally much less, of the order of 5 to 20 km/h, than road or highway signs being of the order or 40 to 110 km/h speed limits, so as to meet Australian and New Zealand standards AS/NZS1170.1 & AS/NZS2890.1:2004 which detail requirements for car parking barriers.

The post 12 includes upper and lower circular mounting holes 20 and 22, which allow an offset member 31 having a hand rail support 33 so that a handrail 17 (such as rail 17.2 in FIG. 15) can be mounted to the post 12 or the beam 19.

Illustrated in FIGS. 5 to 8 is a second post assembly 10.0. In FIGS. 5 to 8, the post assembly 10.0 has parts and features which are similar or the same as the post 10 of earlier figures, and like parts are like numbered. The post assembly 10.0 differs from the post 10 in that underneath the base 14 is welded a laterally extending face plate 24, such that a right angle 24.1 is formed with the under surface 14.2 of the forward end of the base plate 14, so as to receive a right angle formed in a edge of deck 13 or concrete slab of a car park deck or floor as illustrated in FIG. 8. A generally triangular gusset plate 26 is welded to a central portion at the rear of the plate 24 and to the center portion of the under surface 14.3 of the rear part of the base plate 14. This allows the base plate 14 to be cantilevered off the edge of the deck 13, and yet provide appropriate support for the post 12. The 90 degree cavity is useful for external corners of 90 degrees such as are provided on a free edge of a car deck 13.

Whereas, the post assembly 10.00 of FIGS. 9 and 10, is a post assembly where like parts with the previous post assemblies 10 and 10.0 have like numbers and like functions. In the embodiment of post assembly 10.00, there is a base plate 14 which has a vertically upwardly extending rear plate 15 with horizontally extending mounting holes 15.1 therein, to allow the base of post assembly 10.00 to be secured to the deck 13, but also to a concrete wall or building façade panels and or mounting systems, that is, the post assembly 10.00 can be used in an internal 90 degree corner situation. It will be noted that the post 12 in assembly 10.00 is spaced from the rear plate 15 by a distance 40, so that the post 12 can still elastically deform relative to the base plate 14.

Illustrated in FIGS. 11 to 17 is another post assembly 10.000 where like parts with the previous post assemblies 10, 10.0, 10.00 have like numbers and like functions. In the embodiment of post assembly 10.000, the base 14 is constructed like previous embodiments, the main difference being that the post 12 is of a height from the base 14 of 2 meters, where the previous posts were generally of a height 500 mm to 750 mm.

Figures 15, 16, 17:
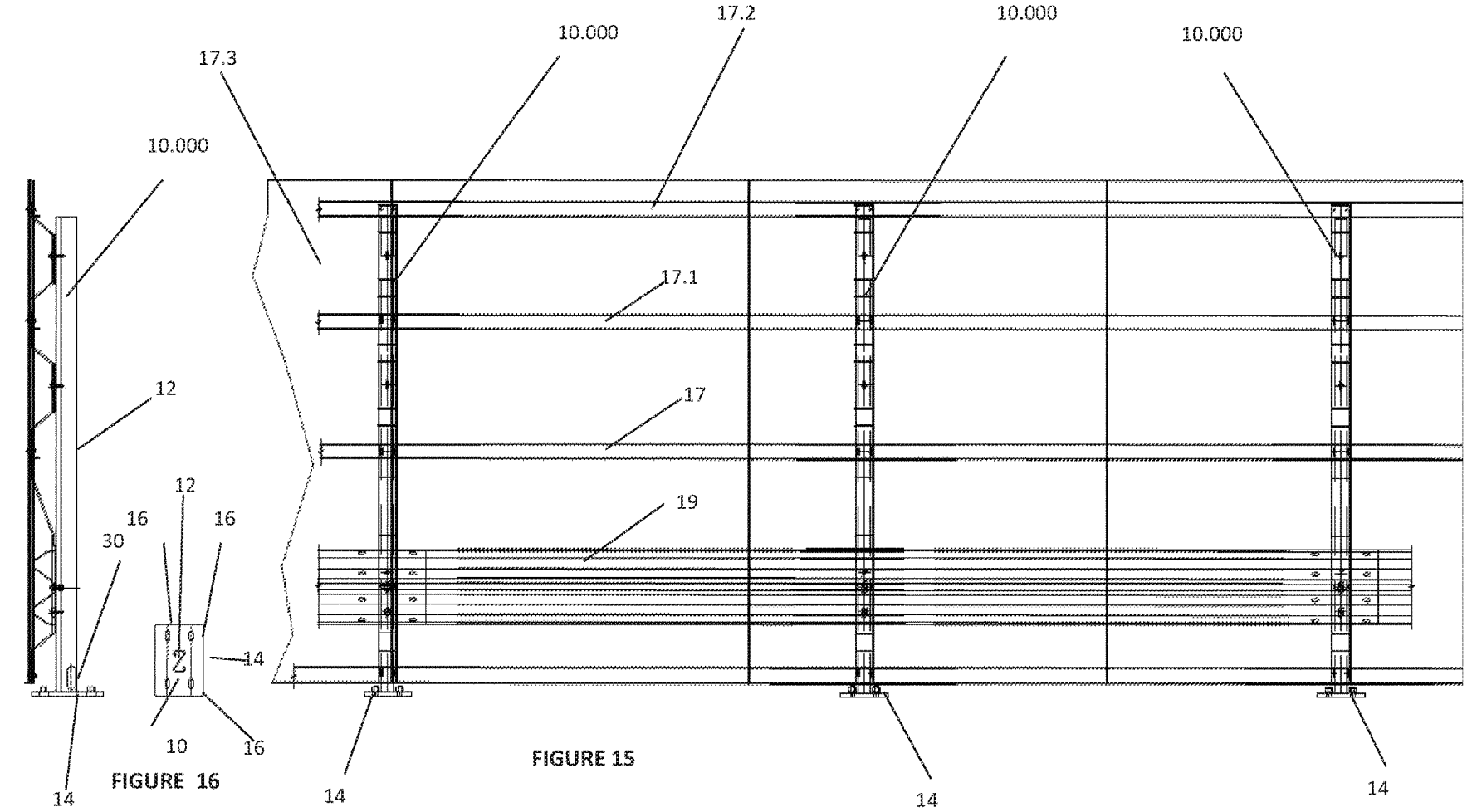
FIG. 15 illustrates a front view of a parking lot barrier assembly with the post and base of FIG. 11.
FIG. 16 illustrates a plan view of a post and base with additional mounting apertures in the base.
FIG. 17 illustrates a side elevation of the assembly of FIG. 15.

As is best seen in FIGS. 15, 16 and 17, the post 10.000 allows for an assembly which has a two lobe beam 19, and can allow a first rail 17 to be attached, and a second rail 17.1 and third rail 17.2, and a mesh 17.3 to close off the opening at the edge of a deck 13 between that deck and an upper deck to make the car parking deck safe for pedestrians.

Figure 18:
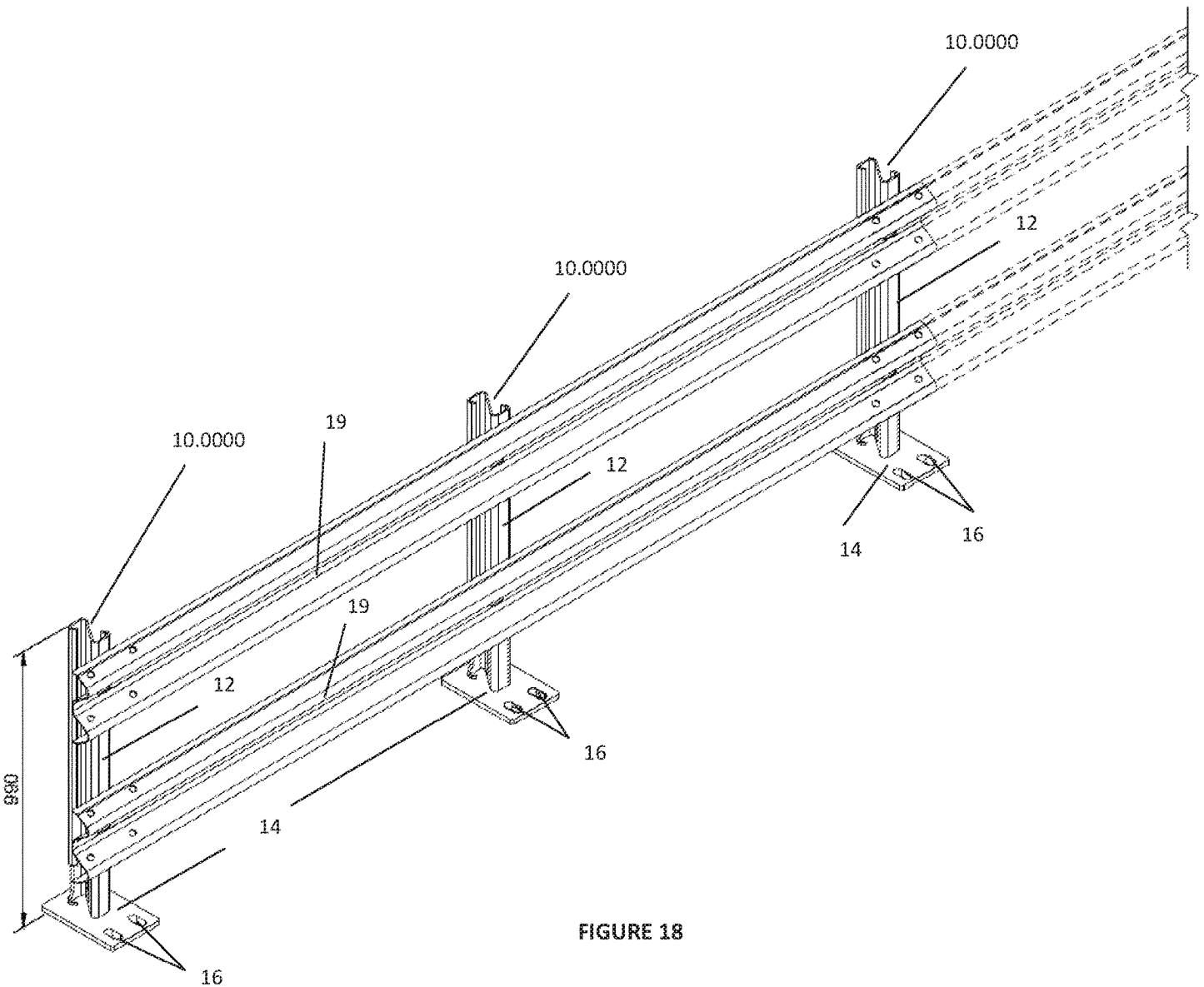
FIG. 18 illustrates plan view of a parking lot guard rail assembly utilizing a mid-size post similar to that of FIG. 1.
Figure 19:
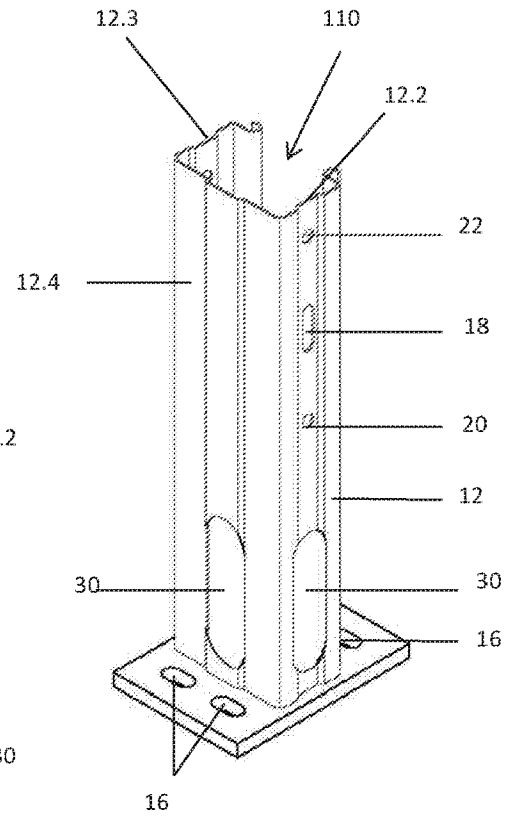
FIGS. 19 to 25 illustrate a perspective view, front view, right side view, rear view, left side view, plan view and underneath view respectively of an O-post or Ochoa post embodying the invention.
Figure 23:
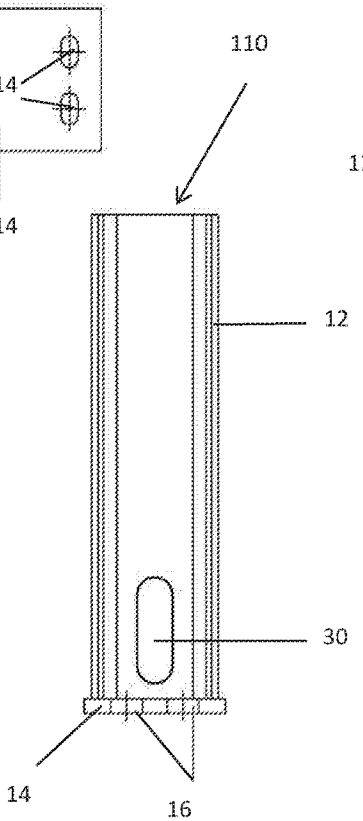
Figure 25:
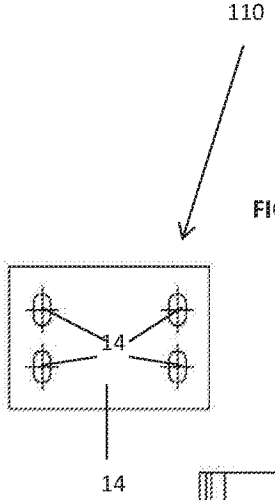
Figure 22:
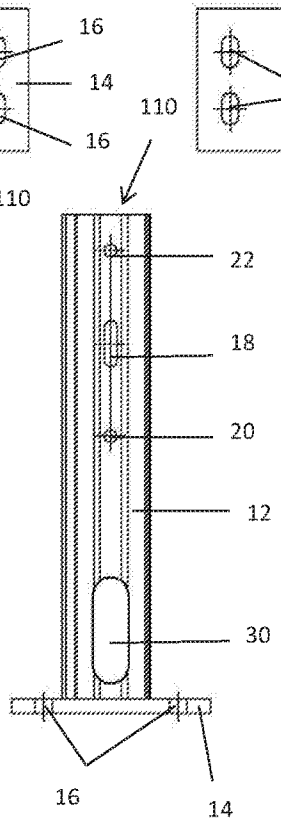
Figure 24:
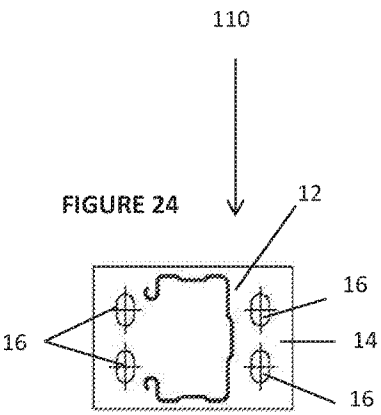
Figure 21:
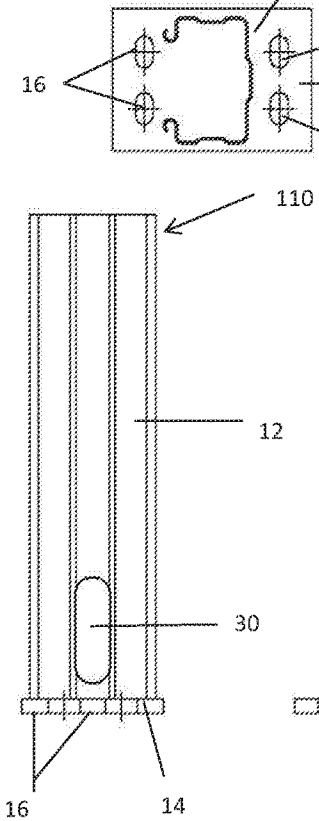
Figure 20:
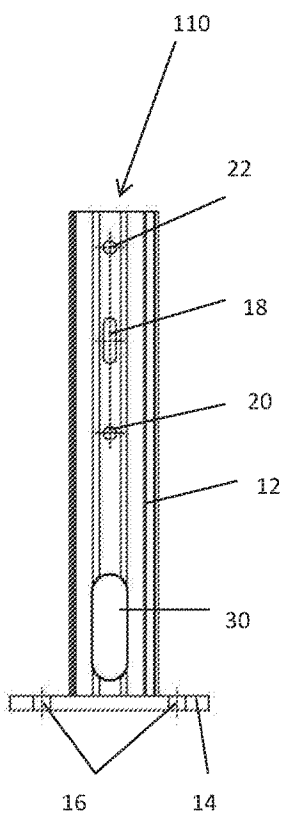
Figure 26:
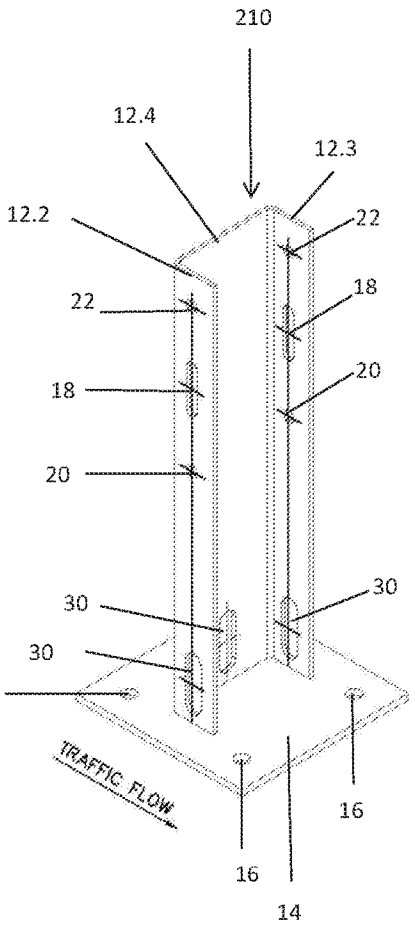
FIGS. 26 to 32 illustrate a perspective view, front view, right side view, rear view, left side view, plan view and underneath view respectively of an U section post embodying the invention.
Figure 30:
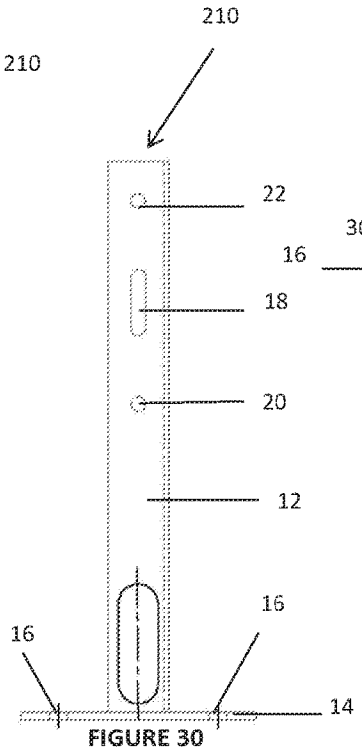
Figure 32:
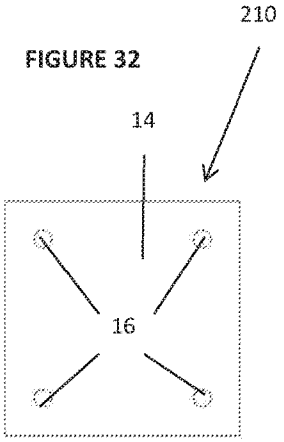
Figure 29:
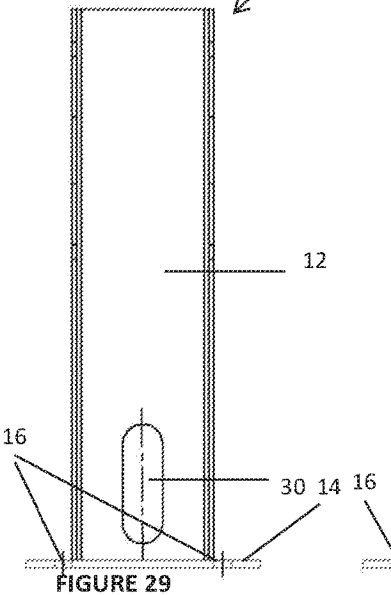
Figure 31:
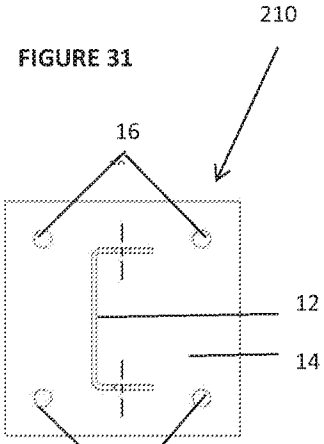
Figure 28:
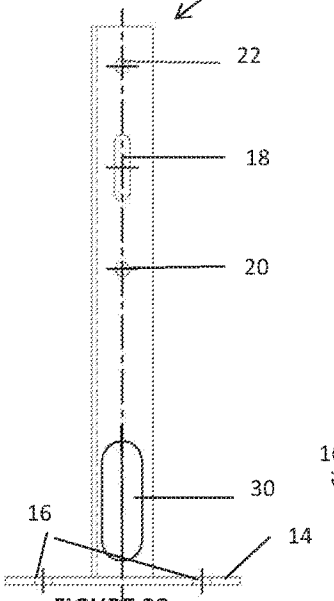
Figure 27:
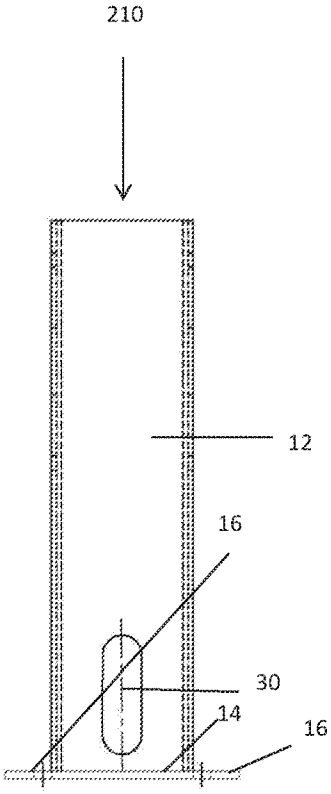

As illustrated in FIG. 18 the post assembly 10.0000, being another embodiment has a post 12 which has a height of approximately 990 mm from the base plate 14. With such a post height the post assembly 10.0000 can carry and have mounted to it, two levels of two lobe or three lobe beams 19, depending upon the requirements and application to which the post assembly 10.0000 is applied.

The post 12 can have any appropriate cross section which can be generally described as one of the following: C-cross section or Charlie post (FIGS. 26 to 32); U-cross section (FIGS. 26 to 32); I-cross section (not illustrated); H-cross section (not illustrated); Z-cross section (FIGS. 1 to 18); Ochoa or O-post cross section (FIGS. 19 to 25).

The Ochoa post or O-post configuration of the post assembly 110, has an O-post 12 as illustrated in FIGS. 19 to 25. Like parts have been like numbered and serve a like function as in embodiments of post assemblies 10, 10.0, 10.00, 10.000 and 10.0000. The O-post 12 of FIGS. 19 to 25 has three obround or elongated apertures 30, one in each of the front flange 12.2, rear flange 12.3 and web 12.4. As the O-post configuration has a curled free end to the flanges 12.2 and 12.3, a discontinuous aperture, similar to aperture 32 may be made in the free end of the flanges 12.2 and 12.3, because of the extra strength such curled edges can provide. Likewise with the assembly 310 and its Charlie post or C-section post 12 of FIGS. 33 to 39, as briefly discussed below.

Illustrated in FIGS. 26 to 32 is post assembly 210, which has a U-section post 12. Like parts have been like numbered and serve a like function as in embodiments of post assemblies 10, 10.0, 10.00, 10.000, 10.0000 and 110.

Illustrated in FIGS. 33 to 39 is post assembly 310, which has a Charlie post or C-section post 12. Like parts have been like numbered and serve a like function as in embodiments of post assemblies 10, 10.0, 10.00, 10.000, 10.0000, 110 and 210. The post 12 of FIG. 33 differs from the post 12 of FIG. 26 in that a U-section does not have the inwardly directed free ends present on the Charlie post.

The guard rail assemblies described above can, via mounting holes 20 and 22, also include hand rails 17 mounted by means of offset members 31 supporting the hand rails by cradles 33 as illustrated in FIG. 8 and the offset members 31 being mounted to the posts or they can alternatively be mounted to the beams 19 extending between the posts 12.

The post of FIGS. 1 to 18 and 19 to 39 produce a relatively high strength semi-rigid barrier system, and whereby the aperture or slots 30 in the webs 12.4 and or rear flanges 12.3 and or front flanges 12.2, and or the apertures 32 in the rear flange 12.3 of the post 12, all located toward the base 12.1 of the post 12, assists to weaken the post 12 which thereby allows the post 12 to yield in a predictable and repeatable manner. This has the benefit of preventing overloading of the system anchors.

Under minor impacts the post deforms elastically, springing back to its original position once the force is removed, whereas in major impact will cause the post to undergo plastic deformation at the weakened point, preventing permanent damage to the anchor or concrete structure 13.

The preferred manufacturing method for the post assemblies 10, 10.0, 10.00, 10.000, 10.0000, 110, 210 and 310 is to first form the closed periphery through apertures or slots 30 and the open periphery or discontinuous through apertures 32, and the mounting apertures 18, 20 and 22, in a generally flat 4.3 mm mild steel plate, by laser cutting, electron beam cutting or water jet cutting methods, or punching or any appropriate method. Then the cut plate is passed through roll forming dies or in a bending machine to form the respective post 12. Once so formed, a base plate 14 with pre-cut mounting holes 16, of a desired number, can then be welded to a respective post 12. Once this step is achieved the resultant post assembly 10, 10.0, 10.00, 10.000, 10.0000, 110, 210 or 310 is then galvanized, and is ready for installation.

The post 12 as described above has a shape and construction as is described in detail in WO2010/105307, which is incorporated herein by reference. In particular reference is made to FIG. 113 and paragraphs 352 and 353 from the size of angles, and dimensions. It will be noted that the post described therein is made from roll forming or pressing, from an AS/NZS1594-HA300 steel (ASTM A 1011 SS Grade 40, 45 or JISG3101 SS400 or EN10025S275JR equivalents) coil of sheeting approximately 4.3 mm in thickness.

A single post 12 as described above in a post assembly 10, 10.0, 10.00, 10.000, 10.0000, 110, 210 or will have an elastic limit of 15 kN force applied 500 mm from the base. Once the W-Beam or THRIE brand of beam (being a 2 lobe beam and a 3 lobe beam respectively) is assembled with at least two post assemblies and fastened, it is expected that the elastic limit will reached when an impact force of approximately 45 kN is applied at a height of approximately 500 mm. This equates to a 1454 kg vehicle at a speed of 7.49 km/h. The deformation at this level of momentum and energy is relatively slight. Increased impact forces will elastically deform the posts further, up to a practical speed of 18 km/h.

While the above embodiments have the apertures 30 and 32 being of an elongated shape, such as a slot or an obround hole, a sufficiently large round aperture may well be suitable to achieve the advantages of the invention. Other shapes may also be satisfactory. The shape chosen however will be required to leave in place sufficient post or parent material to provide sufficient strength to the post but removes enough material to provide a predictable yield point.

It will be noted that the above description of the embodiments locates the apertures 30 in the webs 12.4 either close to the rear flange 12.3, or in the center of the web 12.4. It is expected that locating the apertures 30 closer to the front flange 12.2 may also achieve a similar effect.

Wherever it is used, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

It will be understood that the invention disclosed and defined herein extends to all alternative combinations of two or more of the individual features mentioned or evident from the text. All of these different combinations constitute various alternative aspects of the invention.

While particular embodiments of this invention have been described, it will be evident to those skilled in the art that the present invention may be embodied in other specific forms without departing from the essential characteristics thereof. The present embodiments and examples are therefore to be considered in all respects as illustrative and not restrictive, and all modifications which would be obvious to those skilled in the art are therefore intended to be embraced therein.

The invention claimed is:

1. A post assembly for a parking lot barrier system, a post of said post assembly having at or near to a base of said post there is located at least one aperture which is sized and shaped so as to allow said post to deform elastically under collision loads at low speeds, said post in cross-section includes two flanges connected together by a connecting web, one of said two flanges having a free edge, and said at least one aperture is formed therein, such that said aperture has a discontinuous periphery.

2. The post assembly as claimed in claim 1, wherein said at least one aperture is elongated whereby a longitudinal axis of said aperture is located generally in a vertical direction.

3. The post assembly as claimed in claim 1, wherein said at least one aperture is located in a rear flange of said two flanges.

4. The post assembly as claimed in claim 1, wherein said at least one aperture is located in said web.

5. The post assembly as claimed in claim 4, wherein said at least one aperture is located in said web at a location which is closer to a rear flange of said two flanges of said post than to a front flange of said two flanges.

6. The post assembly as claimed in claim 4, wherein said at least one aperture is located in said web at location which is closer to a front flange of said post than to a rear flange.

7. The post assembly as claimed in claim 4, wherein said at least one aperture is located in said web at a central location relative to the width of said web.

8. The post assembly as claimed in claim 1, wherein there is at least one aperture in at least a rear flange and said web.

9. The post assembly as claimed in claim 1, wherein each flange and said web includes at least one of said at least one aperture.

10. The post assembly as claimed in claim 1, wherein said post has a flange with a free edge, and has said at least one aperture formed therein, such that said aperture has a discontinuous periphery.

11. The post assembly as claimed in claim 1, wherein one flange has a free edge, and said at least one aperture is formed therein, such that said aperture has a periphery which is closed.

12. The post assembly as claimed in claim 1, wherein said at least one aperture formed therein is such that said aperture has a periphery which is closed.

13. The post assembly as claimed in the claim 1, wherein said at least one aperture includes a plurality of apertures including at least one peripherally closed aperture and one peripherally open aperture.

14. The post assembly as claimed in claim 1, wherein said post includes at least one mounting hole to mount a two lobe beam or a three lobe beam to said post.

15. The post assembly as claimed in claim 1, wherein said post includes mounting holes to mount a rail support to said post.

16. The post assembly as claimed in claim 1, wherein said post has a cross section which can be generally described as one of the following: C-cross-section; U-cross-section, I-cross-section; H-cross-section; Z-cross-section; and Ochoa or O-post cross-section.

17. The post assembly as claimed in claim 1, wherein said post assembly includes a base plate attached to said post for securing said assembly to an anchor pad or foundation or concrete formation.

18. The post assembly as claimed in claim 17, wherein said base plate is at least one of the following: flat; able to be positioned on an external corner; able to be positioned on an internal corner; able to be positioned on an external corner of 90 degrees; and able to be positioned on an internal corner of 90 degrees.

19. A guard rail assembly comprising:

a multiple number of post assemblies as claimed in claim 1, and a two lobe beam or a three lobe beam mounted to said posts.

20. The guard rail assembly as claimed in claim 19, wherein said assembly also includes hand rails mounted to offset members to support said hand rails.

21. The guard rail assembly as claimed in claim 20, wherein said offset members are mounted to said posts or said beams extending between said posts.

* * * * *